US008967971B2

(12) United States Patent
Day

(10) Patent No.: US 8,967,971 B2
(45) Date of Patent: Mar. 3, 2015

(54) FLUID PUMP

(75) Inventor: Terence Robert Day, Mount Tamborine (AU)

(73) Assignee: New Fluid Technology Pty Ltd. (AU)

( * ) Notice: Subject to any disclaimer, the term of this patent is extended or adjusted under 35 U.S.C. 154(b) by 998 days.

(21) Appl. No.: 12/901,671

(22) Filed: Oct. 11, 2010

(65) Prior Publication Data

US 2011/0064568 A1 Mar. 17, 2011

Related U.S. Application Data

(63) Continuation-in-part of application No. PCT/AU2009/000421, filed on Apr. 7, 2009.

(51) Int. Cl.
*F04D 29/28* (2006.01)
*F04D 29/22* (2006.01)

(52) U.S. Cl.
CPC ..... *F04D 29/2277* (2013.01)
USPC ..... 416/186 R; 415/206

(58) Field of Classification Search
USPC ..... 415/203, 204, 206, 224.5, 224, 225; 416/186 R, 185, 188
See application file for complete search history.

(56) References Cited

U.S. PATENT DOCUMENTS

| | | | | |
|---|---|---|---|---|
| 2,160,666 A | | 5/1939 | McMahan | |
| 2,272,454 A | | 2/1942 | Wilfley | |
| 2,329,696 A | * | 9/1943 | Thomas | 416/188 |
| 2,635,548 A | * | 4/1953 | Brawley | 406/99 |
| 3,628,881 A | | 12/1971 | Herrmann | |
| 4,082,478 A | * | 4/1978 | Schmitz | 415/211.2 |
| 4,375,937 A | | 3/1983 | Cooper | |
| 4,926,629 A | | 5/1990 | Eick et al. | |
| 6,015,434 A | | 1/2000 | Yamane | |
| 2005/0265832 A1 | * | 12/2005 | Horng et al. | 415/206 |
| 2011/0008153 A1 | | 1/2011 | Kato et al. | |

FOREIGN PATENT DOCUMENTS

| | | |
|---|---|---|
| CN | 1959118 A | 5/2007 |
| KR | 2003-0047711 | 6/2003 |
| WO | WO 2010/147932 A1 | 12/2010 |

OTHER PUBLICATIONS

International Search Report as issued in the parent International Application PCT/AU2009/000421; mailed Jul. 27, 2009.

(Continued)

*Primary Examiner* — Richard Edgar
(74) *Attorney, Agent, or Firm* — Locke Lord LLP; Peter J. Fallon

(57) ABSTRACT

An apparatus for pumping or compressing a fluid, the apparatus comprising:

a housing having a front wall, a rear wall and one or more side walls interconnecting the front and rear walls to define a fluid rotation chamber;

at least one inlet located substantially centrally in the front wall;

an impeller located at least partially within the at least one inlet such that at least a portion of the impeller extends outwardly beyond at least a portion of the front wall; and at least one outlet, wherein rotation of the impeller causes fluid entering the apparatus through the at least one inlet to rotate within the fluid rotation chamber prior to exiting the apparatus through the at least one outlet.

15 Claims, 15 Drawing Sheets

(56) References Cited

OTHER PUBLICATIONS

Written Opinion of the International Searching Authority as issued in the parent International Application PCT/AU2009/000421; mailed Jul. 27, 2009.

English Translation of the Abstract of KR 2003-0047711; Kang Chi Hwang, "Liquid Feeding Pump Having Conical Shaped Impeller", published Jun. 18, 2003.

* cited by examiner

FLUID PUMP

The present application is a continuation-in-part patent application of international patent application no. PCT/AU2009/000421, and further claiming priority from Australian provisional patent application nos. 2010900215 filed 21 Jan. 2010 and 2010901877 filed 3 May 2010.

FIELD OF THE INVENTION

The present invention relates to a pump. In particular, the present invention relates to a fluid pump, especially a fluid pump that utilizes the principle of solid-body rotation.

BACKGROUND ART

Pumps are commonly used for a wide variety of different applications. Common conventional varieties of pump include positive displacement pumps (such as those comprising a reciprocating piston in a cylinder) and non-positive displacement pumps (such as those comprising centrifugal impellers which fling fluid into a diffusing passageway).

Conventional centrifugal fluid pumps employ a rotating impeller that draws in fluid (for instance, water or air) before ejecting the fluid at high speed from the tips of the impeller blades into one or more diffusing passageways. The purpose of the diffusing passageways is to reduce the high kinetic energy imparted to the fluid by the impeller. This is achieved through providing the diffusing passageways with a progressively increasing cross sectional area that causes the fluid to decelerate in a controlled manner. As fluid speed decreases, an increase in static pressure takes place.

This increase in static pressure is required in many pump applications in order to overcome downstream resistance to the flow of fluid caused by fluid drag against pump walls, surfaces, bends, cross-sectional area changes or introduced elements such as filters.

These conventional pumps suffer from a number of significant disadvantages. Firstly, the impeller flings fluid (such as water) off the tips of the blades into the diffusing passageways but not does force it into the diffusing passageways. This means that the diffuser inlets must be placed close to the blade tips so that the fluid velocity is as high as practical as the fluid enters the passageways. This arrangement results in wake collisions which generate a significant amount of noise.

Another disadvantage of conventional pumps is that, due to a large number of cross-sectional area changes through the passageways within the impeller, casing and pump body, the velocity of the fluid changes repeatedly as the fluid moves through the pump. These velocity changes generally result in a decrease in fluid momentum, meaning that additional power input is required to compensate for the loss in fluid momentum, resulting in a reduction in the efficiency of the pump.

A further disadvantage of conventional pumps is the significant cost of manufacturing the one or more diffusing passageways that are integral to conventional centrifugal pumps.

Thus, there would be an advantage if it were possible to provide a fluid pump that reduced or eliminated at least some of the inefficient design features of conventional centrifugal fluid pumps, thereby providing a pump having improved efficiency and reduced noise.

It will be clearly understood that, if a prior art publication is referred to herein, this reference does not constitute an admission that the publication forms part of the common general knowledge in the art in Australia or in any other country.

Throughout this specification, the term "comprising" and its grammatical equivalents shall be taken to have an inclusive meaning unless the context of use indicates otherwise.

OBJECT OF THE INVENTION

It is an object of the present invention to provide a fluid pump which may overcome at least some of the abovementioned disadvantages, or provide a useful or commercial choice.

In a first aspect, the invention resides broadly in an apparatus for pumping or compressing a fluid, the apparatus comprising:

- a housing having a front wall, a rear wall and one or more side walls interconnecting the front and rear walls to define a fluid rotation chamber;
- at least one inlet;
- an impeller located at least partially within the at least one inlet such that at least a portion of the impeller extends outwardly beyond at least a portion of the housing; and
- at least one outlet, wherein rotation of the impeller causes fluid entering the apparatus through the at least one inlet to rotate within the fluid rotation chamber prior to exiting the apparatus through the at least one outlet.

The housing of the apparatus may be a unitary housing, a two-part housing or a multiple part housing in which the parts are attached together. Typically, the housing comprises a two-part housing consisting of an upper part and a lower part which are fastened together typically via separate fasteners such as screws, bolts and the like. Each housing part may be of any suitable size, shape or configuration. In some embodiments of the invention, a first housing part may contain the at least one inlet while a second housing part may contain the at least one outlet. Alternatively, each housing part may contain both the at least one inlet and the at least one outlet.

The front and rear walls of the housing may be of any suitable size, shape or configuration. However, in a preferred embodiment of the invention, the front and rear walls of the housing are substantially the same size and shape as one another. In some embodiments of the invention, the front and rear walls of the housing are substantially circular in plan view. Thus, in this embodiment of the invention, the housing is substantially cylindrical.

The one or more inlets may be located at any suitable point on the housing. For instance, the one or more inlets may be located in the side wall or the front wall of the housing. The one or more inlets may be located such that fluid enters the apparatus tangentially to the side wall of the apparatus.

Alternatively, the one or more inlets may be located substantially centrally in the front wall of the apparatus. In this embodiment of the invention, the impeller may be located such that at least a portion of the impeller extends outwardly beyond at least a portion of the housing.

In another embodiment of the invention, the apparatus may comprise one or more tangential inlets and one or more substantially centrally located inlets.

As previously mentioned, the front wall of the housing includes one or more inlets located substantially centrally therein. In some embodiments of the invention, the one or more inlets may be associated with one or more inlet passageways, such that fluid entering the apparatus passes through the one or more inlet passageways prior to entering the apparatus through the one or more inlets.

The one or more inlet passageways may be of any suitable size, shape or configuration. In some embodiments of the invention, the one or more inlet passageways may be adapted to connect to the front wall of the housing. Alternatively, in some embodiments of the invention, the front wall of the housing may consist of a raised portion at or adjacent the one or more inlets that projects outwardly from the surface of the front wall. In these embodiments of the invention, the raised portion may be adapted for connection to the one or more inlet passageways.

In some embodiments, the one or more inlet passageways may be formed integrally with the housing. In other embodiments of the invention, the one or more inlet passageways may be formed separately from the housing and may be adapted for temporary or permanent engagement therewith, using any suitable technique.

The impeller may be of any suitable form. However, in a preferred embodiment of the present invention, the impeller is provided with one or more blades and, more preferably, a plurality of blades. In a most preferred embodiment of the invention, the impeller is provided with a plurality of curved blades.

As has been stated previously, the impeller may be located at least partially within the at least one inlet such that at least a portion of the impeller extends outwardly beyond at least a portion of the front wall. In embodiments of the invention in which the one or more inlets are provided with a raised portion, the impeller may be located at least partly within the raised portion. Alternatively, the impeller may be located at least partly within the inlet passageway, if one is present.

As previously mentioned, the walls of the housing serve to define a fluid rotation chamber. In some embodiments of the invention, fluid is introduced into the apparatus through the one or more inlets, is ejected from the impeller into the fluid rotation chamber. In a preferred embodiment of the invention, the rotation of fluid within the fluid rotation chamber is in the form of solid-body rotation, in which the rotating fluid acts substantially as a solid body rather than a fluid. Preferably, the impeller and the body of rotating fluid in the fluid rotation chamber are substantially co-axial with one another.

There are a number of benefits to achieving solid-body rotation of the fluid. Firstly, the rotating fluid effectively stores momentum, and considerable force is required to slow or arrest the rotation of the fluid. Secondly, as the fluid is rotating as a solid body, substantially no shear forces exist within the body of fluid, meaning that there is substantially no turbulence in the fluid. This lack of turbulence assists in maintaining the efficiency of the apparatus.

The one or more outlets may be of any suitable size, shape or configuration. In a preferred embodiment of the present invention, the one or more outlets may be located tangentially to the direction of rotation of fluid within the fluid rotation chamber. Preferably, the one or more outlets are located in the side walls of the housing. More preferably, the one or more outlets are located at a point in the side walls remote from the one or more inlets in order to reduce the degree of turbulence in the fluid. In a most preferred embodiment of the invention, the apparatus comprises one outlet.

As the fluid rotates in the fluid rotation chamber, the pressure of the fluid is at its greatest adjacent the inner surface of the housing. Thus, by locating the outlet tangentially in a side wall of the housing, the rotating fluid exiting the apparatus through the outlet has the highest pressure required to overcome downstream resistance.

The outlet may be in fluid communication with an outlet passageway (such as a pipe or conduit). While the passageway outlet may be of any suitable shape or configuration, in a preferred embodiment of the invention the outlet passageway is substantially square or rectangular in cross-section along at least a portion of its length. In some embodiments of the invention, the outlet passageway may be substantially square or rectangular in cross-section along the entirety of its length.

In a second aspect, the invention resides broadly in an apparatus for pumping or compressing a fluid, the apparatus comprising:

a housing having a front wall, a rear wall and one or more side walls interconnecting the front and rear walls to define a fluid rotation chamber;

at least one inlet; rotation means adapted to impart rotation to fluid entering the apparatus; and at least one outlet, wherein rotation of the rotation means causes fluid entering the apparatus through the at least one inlet to rotate within the fluid rotation chamber prior to exiting the apparatus through the at least one outlet.

The rotation means may be of any suitable form provided that the rotation means imparts sufficient rotation to the fluid entering the apparatus. For instance, the rotation means may comprise one or more impellers, one or more magnetic (or magnetizable) rotating members within the housing actuable by exerting a magnetic or electromagnetic attraction or repulsion from outside the housing, one or more water jets directed tangentially within the housing, or the like, or any combination thereof.

In embodiments of the invention in which the rotation means comprises one or more impellers, the one or more impellers may be located at any suitable position within the apparatus. For instance, in embodiments of the invention in which a single impeller is present, the impeller may be positioned at least partially within an inlet of the apparatus or wholly within the fluid rotation chamber. The impeller may be positioned at any suitable location within the fluid rotation chamber, such as adjacent an inlet, at a point between the front and rear walls of the housing, or adjacent the rear wall of the housing and so on. In embodiments of the invention in which two or more impellers are present, the two or more impellers may be located at any suitable combination of positions.

The one or more inlets may be located at any suitable point on the housing. For instance, the one or more inlets may be located in the side wall or the front wall of the housing. The one or more inlets may be located such that fluid enters the apparatus tangentially to the side wall of the apparatus.

Alternatively, the one or more inlets may be located substantially centrally in the front wall of the apparatus.

In another embodiment of the invention, the apparatus may comprise one or more tangential inlets and one or more substantially centrally located inlets.

In a third aspect, the invention resides broadly in an apparatus for pumping or compressing a fluid, the apparatus comprising:

a housing having a front wall, a rear wall and one or more side walls interconnecting the front and rear walls to define a fluid rotation chamber;

at least one inlet;

an impeller located at least partially within the at least one inlet; and at least one outlet, wherein rotation of the impeller causes fluid entering the apparatus through the at least one inlet to rotate within the fluid rotation chamber prior to exiting the apparatus through the at least one outlet, and wherein the angle at which the front and rear walls join the one or more side walls is a tightly-radiused curve.

The one or more inlets may be located at any suitable point on the housing. For instance, the one or more inlets may be located in the side wall or the front wall of the housing. The one or more inlets may be located such that fluid enters the apparatus tangentially to the side wall of the apparatus.

Alternatively, the one or more inlets may be located substantially centrally in the front wall of the apparatus. In this embodiment of the invention, the impeller may be located such that at least a portion of the impeller extends outwardly beyond at least a portion of the housing.

In another embodiment of the invention, the apparatus may comprise one or more tangential inlets and one or more substantially centrally located inlets.

As mentioned above, the angle at which the front and rear walls join the one or more side walls is a tightly-radiused curve. In a preferred embodiment of the invention, the radius of the tightly-radiused curve is less than 10 mm. More preferably, the radius of the tightly-radiused curve is less than 5 mm. Still more preferably, the radius of the tightly-radiused curve is between 1 mm and 2 mm. The radius of the tightly-radiused curve between the front wall and the side wall may be the same or different to that between the rear wall and the side wall. In a preferred embodiment of the invention, however, the radius of the tightly-radiused curve between the front wall and the side wall may be substantially identical to that between the rear wall and the side wall.

By providing these tightly-radiused curves at the points at which the front and rear walls join the side walls, a fluid rotation chamber having an almost square or rectangular cross-sectional shape may be achieved. It has surprisingly been found that providing a fluid rotation chamber having this substantially cylindrical geometry results in improvements to the efficiency of the apparatus.

In a fourth aspect of the invention, the invention resides broadly in an apparatus for pumping or compressing a fluid, the apparatus comprising:

a housing having a front wall, a rear wall and one or more side walls interconnecting the front and rear walls to define a fluid rotation chamber;
at least one inlet;
an impeller located at least partially within the at least one inlet; and
at least one outlet, wherein rotation of the impeller causes fluid entering the apparatus through the at least one inlet to rotate within the fluid rotation chamber prior to exiting the apparatus through the at least one outlet, and wherein the angle at which the front and rear walls join the one or more side walls is substantially a right angle.

The one or more inlets may be located at any suitable point on the housing. For instance, the one or more inlets may be located in the side wall or the front wall of the housing. The one or more inlets may be located such that fluid enters the apparatus tangentially to the side wall of the apparatus.

Alternatively, the one or more inlets may be located substantially centrally in the front wall of the apparatus. In this embodiment of the invention, the impeller may be located such that at least a portion of the impeller extends outwardly beyond at least a portion of the housing In another embodiment of the invention, the apparatus may comprise one or more tangential inlets and one or more substantially centrally located inlets.

In this embodiment of the invention, it is preferred that the cross-sectional shape of the fluid rotation chamber is substantially square or rectangular. It has surprisingly been found that providing a fluid rotation chamber having this geometry results in improvements to the efficiency of the apparatus.

In some embodiments of the invention (and equally applicable to all aspects of the present invention), the apparatus may be provided with one or more outlet tubes. The one or more outlet tubes may be of any suitable size, shape or configuration. In a preferred embodiment of the invention, a first end of the one or more outlet tubes may extend at least partially into the fluid rotation chamber. The second end of the one or more outlet tubes may extend to the one or more outlets. Alternatively, the second end of the one or more outlet tubes may extend beyond the one or more outlets, such as, for instance, at least partially into the one or more outlet pipes.

The cross-sectional area of the one or more outlet tubes may be of any suitable type. In some embodiments of the invention, the cross-sectional area of the one or more outlet tubes varies across the length of the outlet tubes, while in other embodiments of the invention, the cross-sectional area of the one or more outlet tubes is substantially constant over the length of the one or more outlet tubes. In embodiments of the invention in which a plurality of outlet tubes are present, all of the plurality of outlet tubes may have cross-sectional areas that are substantially constant over the length of the outlet tubes, or all of the outlet tubes may have cross-sectional areas that vary across the length of the outlet tubes, or the outlet tubes may be a combination of the two.

Preferably, the one or more outlet tubes are sized so that the amount of fluid leaving the fluid rotation chamber through the one or more outlet tubes is not so great that the remaining fluid in the fluid rotation chamber can no longer rotate under the principle of solid-body rotation. In some embodiments of the present invention, the one or more outlet tubes have a foil-like cross-sectional shape.

In embodiments of the invention in which a plurality of outlets are present, each outlet may be provided with one or more outlet tubes.

In some embodiments of the invention, the one or more outlet tubes may be the one or more outlets.

By locating the first end of the one or more outlet tubes within the fluid rotation chamber, it can be ensured that fluid rotating at a higher velocity within the chamber than the fluid rotating close to the wall of the housing will be discharged through the one or more outlets. In some embodiments of the invention, the fluid that flows through the one or more outlets is a combination of the higher velocity fluid that discharges through the outlet through the one or more outlet tubes, and the lower velocity fluid rotating close to the wall of the housing. In this embodiment of the invention, the average velocity of the fluid exiting the apparatus through the one or more outlets may be increased through the addition of higher velocity fluid exiting the outlet through the one or more outlet tubes.

In some embodiments of the invention (and equally applicable to all aspects of the present invention), the impeller may have a discharge portion from which the fluid is discharged into the fluid rotation chamber. While the discharge portion of the impeller may be located at any suitable point, in a preferred embodiment of the invention, the discharge portion of the impeller may be located within the fluid rotation chamber. The discharge portion of the impeller may be located at any suitable point within the fluid rotation chamber, such that fluid may be discharged into substantially any point of the fluid rotation chamber.

In some embodiments of the invention the fluid vortex in the fluid rotation chamber may be so strong that centripetal forces result in the pressure in the fluid concentrating at the periphery of the fluid rotation chamber. This, in turn, means that the fluid pressure adjacent to the core of the fluid vortex becomes so low that the fluid may cavitate. Thus, in some embodiments (and equally applicable to all aspects of the present invention), the apparatus may be provided with anti-cavitation means adapted to prevent fluid cavitation.

The anti-cavitation means may be of any suitable size, shape or configuration. In a preferred embodiment, however, the anti-cavitation means are positioned at least partly in the fluid rotation chamber and are adapted to rotate therein. The rotation of the anti-cavitation means may be due to the action of the impeller inducing the rotation of the anti-cavitation means, or, alternatively, the anti-cavitation means may be associated with the impeller in such a way that any rotation of the impeller results in the rotation of the anti-cavitation means. In some embodiments, the anti-cavitation means may be attached to the impeller using any suitable technique.

Preferably, the anti-cavitation means extends between the front and rear walls of the fluid rotation chamber. The anti-cavitation means may extend part-way between the front and rear walls of the fluid rotation chamber, or may extend substantially the entire distance between the front and rear walls of the fluid rotation chamber.

The anti-cavitation means may have any suitable diameter. For instance, the diameter of the anti-cavitation means may be larger than or smaller than the diameter of the impeller with which it is associated. In one embodiment, the diameter of the anti-cavitation means is approximately the same as the diameter of the impeller.

In a preferred embodiment, the anti-cavitations means may be a substantially cylindrical element extending at least partway between the front and rear walls of the fluid rotation chamber. More preferably, the antic-cavitation means may be a hollow cylinder, for instance a spigot or drum, although it will be understood that the anti-cavitation means may alternatively be provided with a plurality of passages therethrough. Further, the cylindrical wall of the anti-cavitation means may be provided with one or more openings such that fluid may pass between the interior of the anti-cavitations means and the fluid rotation chamber at an angle that is approximately perpendicular to the axis about which the anti-cavitation means rotates.

It is envisaged that the anti-cavitation means may be positioned within the fluid rotation chamber so as to substantially replace a cavitating core of the fluid vortex.

The anti-cavitation means may be fabricated from any suitable material (such as, but not limited to, metal, plastic, fibreglass, glass, wood etc, or a combination thereof). However, as the fluid within the fluid rotation chamber behaves essentially as a solid body, it is envisaged that the presence of the anti-cavitation means within the fluid rotation chamber will not have a detrimental effect on the rotation of the fluid.

It is envisaged that the rotation of the anti-cavitation means may also result in the entrainment of fluid in addition to the fluid entrainment achieved by the rotation of the impeller. Thus, the total energy introduced into the fluid is greater than that of the fluid injection achieved by the impeller alone. It is for this reason that the total energy injection may, in some embodiments, cause the fluid vortex to rotate at a different rate (either faster or slower) than the RPM of the impeller. Also, in some embodiments, the RPM of the fluid vortex may be less or the same RPM as the impeller but the speed of the fluid in the vortex close to the vortex periphery may be higher than the speed of the impeller periphery or spigot or drum surface because that part of the fluid vortex is a larger diameter than either the impeller or spigot.

In some embodiments of the invention, a motor may be located within the hollow cylinder of the anti-cavitation means. In some instances, the anti-cavitation means may comprise the motor casing. In this embodiment of the invention the motor may be positioned on the rear wall of the fluid rotation chamber.

The advantages of this arrangement are that it is space saving, with reduced manufacturing costs. In addition, the motor may be water cooled in this method rather than the more conventional air cooling of motors.

A skilled addressee will understand that, in many conventional centrifugal pumps, a seal is required to prevent fluid having a high static pressure from leaking out of the inlet of the pump. Typically, these seals are labyrinth seals and possess a number of labyrinthine turns that the fluid must follow. Due to the geometry of these seals, they are typically fabricated with high precision, making them relatively costly to produce.

In some embodiments of the invention (and equally applicable to all aspects of the present invention) labyrinth seals of the type described above may not be required in the present apparatus. The reason for this is that, as the fluid in the fluid rotation chamber rotates at relatively high rpm, the static pressure in the fluid vortex concentrates at or adjacent the periphery of the vortex. Fluid closer to the centre of the fluid rotation chamber (approximately where a labyrinth seal would be located in conventional pumps) is typically of a relatively low pressure, and often at a lower pressure than then fluid entering the apparatus through the inlet. Thus, a labyrinth seal may not be required.

It is envisaged that the amount of fluid leakage from the inlet area past the front of the anti-cavitation means (if present) will be negligible or inconsequential.

In some embodiments, the housing may include one or more recesses, notches, grooves or the like in which at least a portion of the anti-cavitation means is received during use, thereby further reducing the requirement for precise manufacturing tolerances.

A skilled addressee will understand that, in many conventional centrifugal pumps, a seal is required to prevent fluid leaking along the shaft of the motor associated with the impeller and into the motor. Often, this seal is a mechanical seal, such as a seal composed of one smooth surface of carbon fibre or ceramic rotating against a stationary surface of carbon fibre or ceramic. The internal pressure of a conventional centrifugal pump is greater than atmospheric pressure. As a result, any fluid being pumped is prone to leakage through openings such as where the motor shaft enters the pump body.

As has been previously stated, the pressure in the fluid rotation chamber in the region normally occupied by the mechanical seal is generally lower than the pressure external to the apparatus. As a result, the need for a mechanical seal is reduced or even eliminated altogether. In some embodiments, simple seals (such as O-rings may be sufficient, or, alternatively, a soft material (such as rubber) may be used to prevent fluid leakage along the motor shaft. In some applications, however, a mechanical seal may be desired or required.

In embodiments of the invention in which a soft material is used as a seal, it has been observed that seal movement in the axial direction of the shaft may occur depending on the operating condition of the apparatus.

Thus, in some embodiments, it is preferred that the seal may be provided with means for preventing movement of the seal in the axial direction of the motor shaft. Any suitable means may be provided, although in a preferred embodiment of the invention, the means may include providing one or more angled surface on the outer surface and/or inner surface of the seal.

The purpose of the one or more angled surfaces is that, as the motor shaft rotates, the angled surfaces generate forces that hold the seal against the shaft, therefore preventing movement of the seal in the axial direction of the motor shaft. With this purpose in mind, it will be understood that the one or more angled surfaces may be provided with any suitable geometry to achieve this purpose.

It is envisaged that one or more angled surfaces on the inner surface of the seal may be provided so as to ensure that the seal is in continuous contact with the surface of the motor shaft, even when the diameter of the motor shaft varies along its length.

In a preferred embodiment of the invention, the seal may comprise a substantially annular seal having an passageway therein through which the motor shaft may pass.

In an alternative embodiment, the seal may comprise a sealed bearing.

The present invention provides a number of advantages over the prior art. Firstly, the simplicity of the design of the present invention ensures low manufacturing costs. In addition, the present invention has significantly lower operational costs associated with it.

Further, by eliminating the need to provide one or more diffusing passageways, the present invention produces significantly less noise than prior art devices. This was not previously thought possible, as conventional understanding is that, without diffusing passageways, the pressure development in a pump is inadequate and the pump would operate at sub-optimal efficiency.

BRIEF DESCRIPTION OF THE DRAWINGS

An embodiment of the invention will be described with reference to the following drawings in which.

DETAILED DESCRIPTION OF THE DRAWINGS

Figure 1:
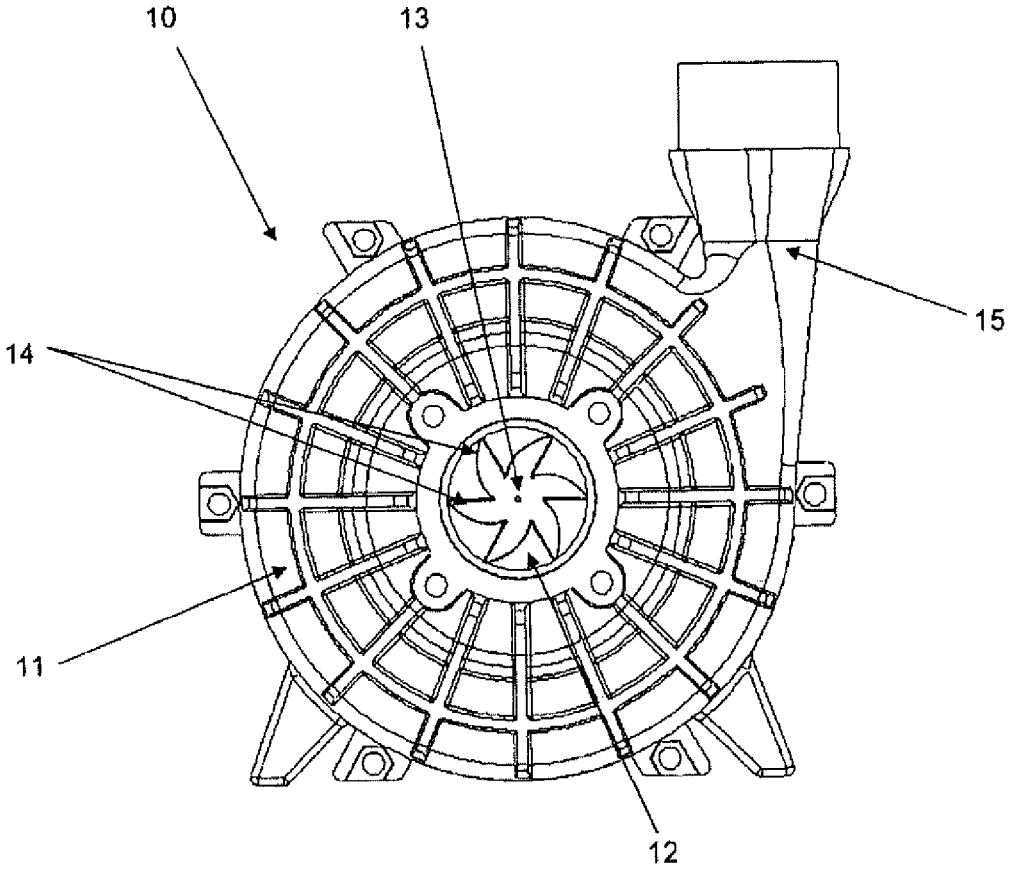
FIG. 1 illustrates a plan view of an apparatus according to an embodiment of the present invention.

It will be appreciated that the drawings have been provided for the purposes of illustrating preferred embodiments of the present invention and that the invention should not be considered to be limited solely to the features as shown in the drawings.

In FIG. 1 there is illustrated a plan view of an apparatus 10 according to an embodiment of the present invention. The apparatus 10 comprises a housing having circular front wall 11 with an inlet 12 located centrally therein. An impeller 13 comprising a plurality of curved blades 14 is located within the inlet 12.

The apparatus 10 further comprises an outlet pipe 15 located tangentially to the circular front wall 11, the outlet pipe 15 being rectangular along a portion of its length.

Figure 2:
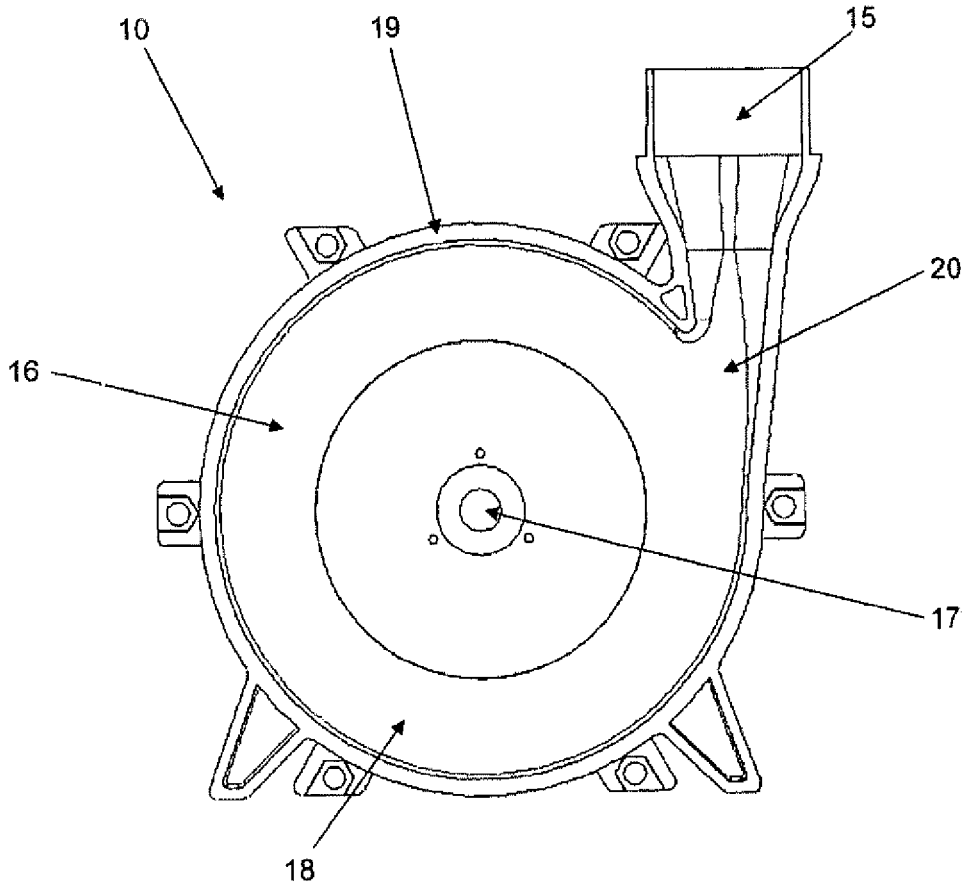
FIG. 2 illustrates a plan cross-sectional view of an apparatus according to an embodiment of the present invention.

FIG. 2 illustrates a cross-sectional view of the apparatus 10 in which the upper part of the housing (including the front wall) has been removed. It may be seen in this Figure that the rear wall 16 of the housing comprising an aperture 17 through which the drive shaft (not shown) for the impeller (not shown) extends.

It may be seen in this Figure that a fluid rotation chamber 18 is defined inside the apparatus 10 by the rear wall 16, the side walls 19 and the front wall (not shown). When in use, fluid rotates inside the fluid rotation chamber 18 according to the principles of solid-body rotation, such that the fluid with the greatest momentum (i.e. that rotating within the chamber 18 adjacent the side wall 19 is ejected from the apparatus 10 through the outlet 20. Fluid exiting the apparatus 10 through the outlet 20 then travels through the outlet pipe 15.

Figure 3:
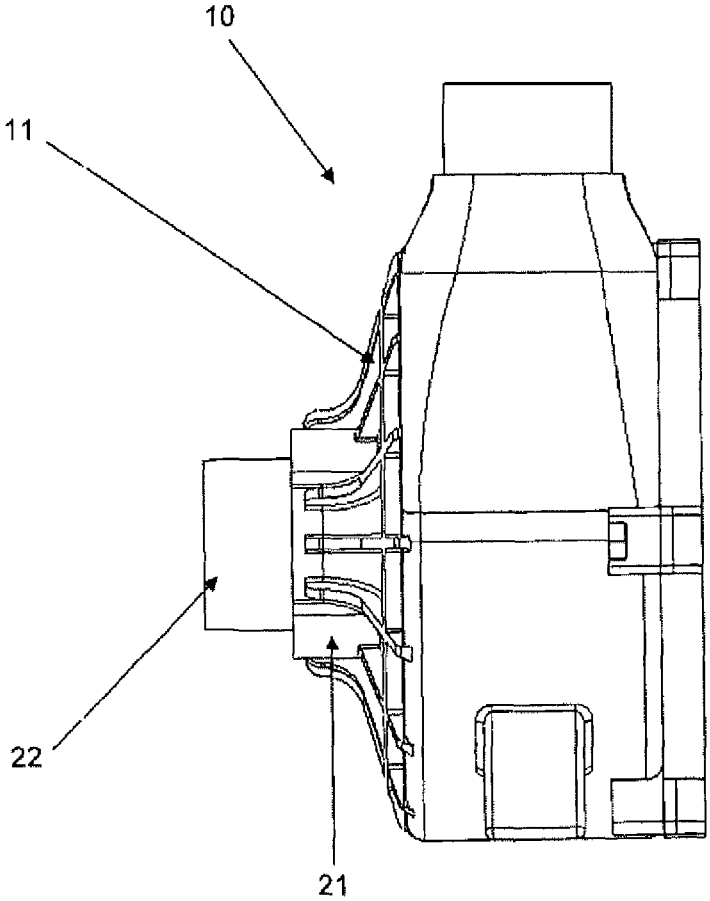
FIG. 3 illustrates a side view of an apparatus according to an embodiment of the present invention.

In FIG. 3, a side view of the apparatus 10 is illustrated. In this Figure it is shown that the front wall 11 comprises a raised portion 21 that surrounds the inlet (obscured) and extends outwardly from the front wall 11.

In this Figure, an inlet passageway 22 is also shown. The inlet passageway 22 is in fluid communication with the inlet (obscured). In this embodiment of the invention, the inlet passageway 22 is formed integrally with the front wall 11 of the apparatus 10.

Figure 4:
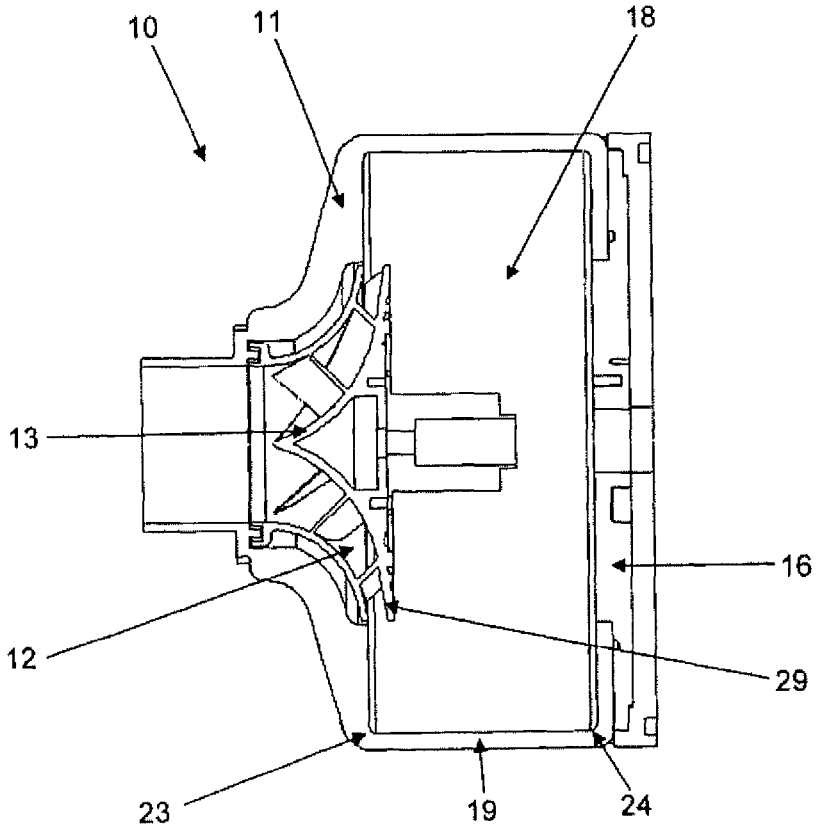
FIG. 4 illustrates a side cross-sectional view of an apparatus according to an embodiment of the present invention.

In FIG. 4 a cross-sectional side view of the apparatus 10 is shown. In this Figure it may be seen that the impeller 13 is located in the inlet 12 in such a manner that a portion of the impeller 13 extends outwardly beyond at least a portion of the front wall 11 of the housing. In this way, fluid entering the apparatus 10 through the inlet 12 immediately has rotation imparted to it by the impeller 13 prior to entering the fluid rotation chamber 18.

The corner 23 at which the front wall 11 joins the side wall 19 and the corner 24 at which the rear wall 16 joins the side wall 19 are provided with tightly-radiused curves. In the embodiment of the invention illustrated in FIG. 4, the radius of the tightly-radiused curves is approximately 1.5 mm.

The radius of the tightly-radiused curves is maintained as low as possible in order to provide the fluid rotation chamber 18 with a suitable geometry for encouraging solid-body rotation of the fluid therein. It has surprisingly been found that providing the fluid rotation chamber 18 with such tightly-radiused curves at the corners where the front 11 and rear 16 walls join the side walls 19 increases the efficiency with which the apparatus 10 operates by promoting solid-body rotation of the fluid.

In some embodiments of the invention, the corners 23, 24 may be at substantially 90° angles. While this would provide a geometry that would improve the efficiency of the pump, it is also possible that this would lead to the accumulation of mechanical stresses at the corners 23, 24. Thus, providing a tightly-radiused curve at the corners 23, 24 may overcome the accumulation of mechanical stresses without any significant loss of pump efficiency.

It may be further seen in FIG. 4 that impeller 13 has a discharge portion 29 from which fluid is discharged into the fluid rotation chamber 18. The discharge portion 29 of the impeller 13 is located entirely within the fluid rotation chamber 18 and, in the embodiment of the invention shown in FIG. 4, is adapted to discharge fluid into the fluid rotation chamber in a direction substantially parallel to the front wall 11.

Figure 5:
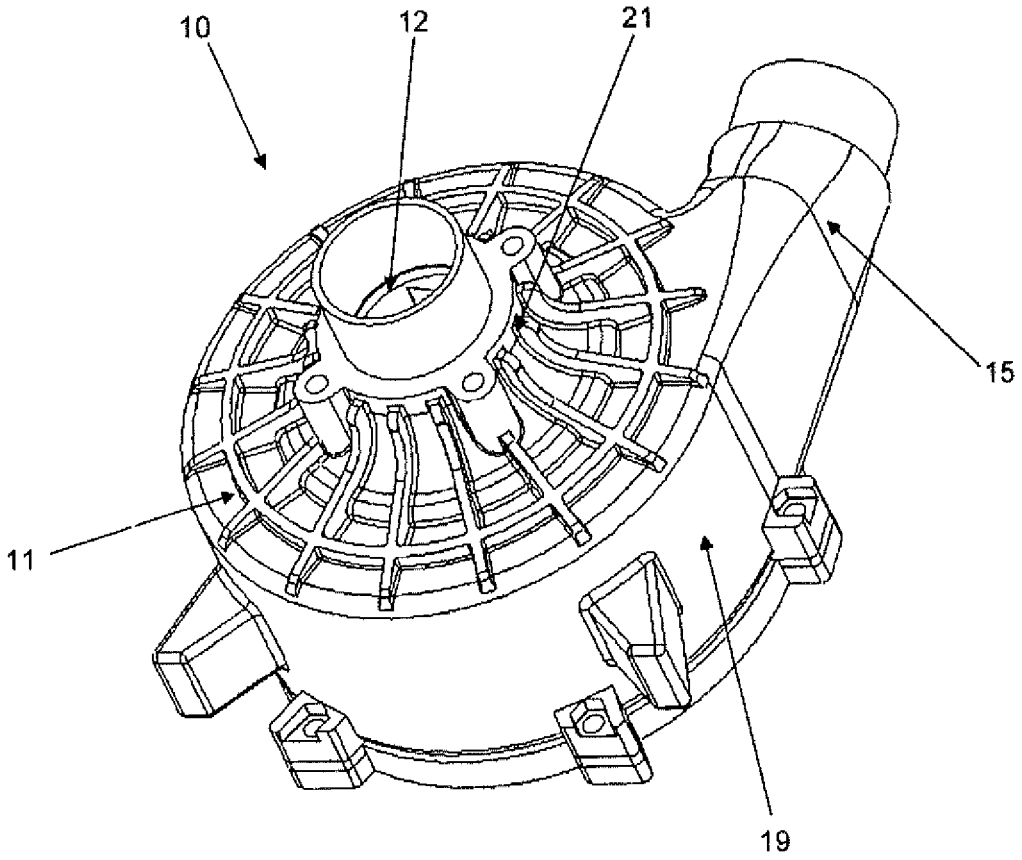
FIG. 5 illustrates a perspective view of an apparatus according to an embodiment of the present invention.

In FIG. 5, a perspective view of the apparatus 10 according to an embodiment of the present invention is shown. In this Figure, the raised portion 21 of the front wall 11 surrounding the inlet 12 may be clearly seen. Further, the tangential location in the side wall 19 of the outlet (obscured) and the outlet pipe 15 may be seen.

It may also be seen more clearly in this Figure that the front wall 11, side wall 19 and rear wall (obscured) serve to define an essentially cylindrical housing for the apparatus 10.

Figure 6:
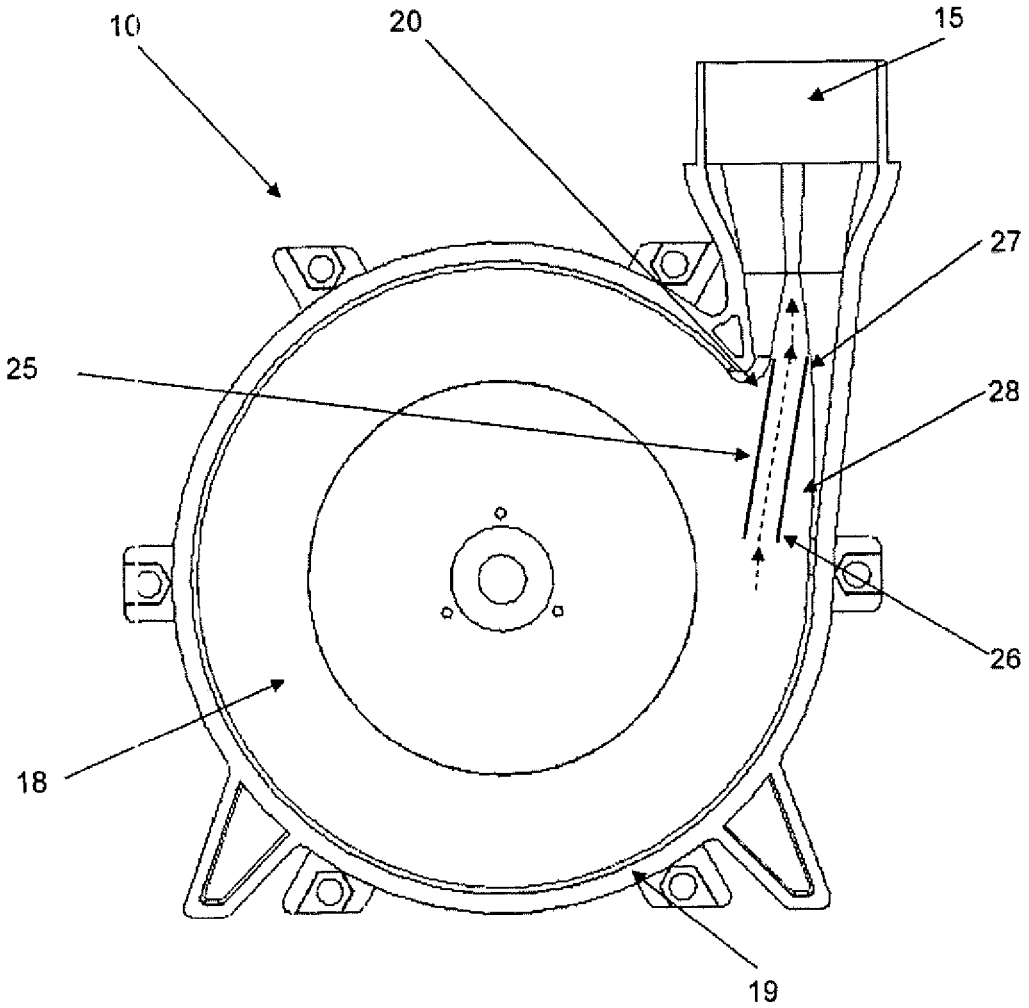
FIG. 6 illustrates a plan cross-sectional view of an apparatus according to an embodiment of the present invention.

In FIG. 6 there is shown an apparatus 10 according to an alternative embodiment of the present invention. In this Figure, the apparatus 10 is provided with an outlet tube 25. The outlet tube 25 has a first end 26 which extends into the fluid rotation chamber 18 to capture higher velocity fluid which passes through the outlet tube 25 and exits the apparatus 10 through the outlet pipe 15.

In the embodiment of the invention shown in FIG. 6, the outlet tube 25 has a second end 27 which extends beyond the outlet 20 and into the outlet pipe 15. The location of the outlet tube 25 creates a passageway 28 between the outlet tube 25 and the side wall 19 of the housing through which lower velocity fluid rotating close to the side wall 19 can exit through the outlet 20. In this way the fluid exiting the apparatus 10 through the outlet pipe 15 is combination of higher and lower velocity fluid. Thus, the presence of the outlet tube 25 serve to increase the average velocity (and therefore momentum) of the fluid leaving the apparatus 10.

Figure 7:
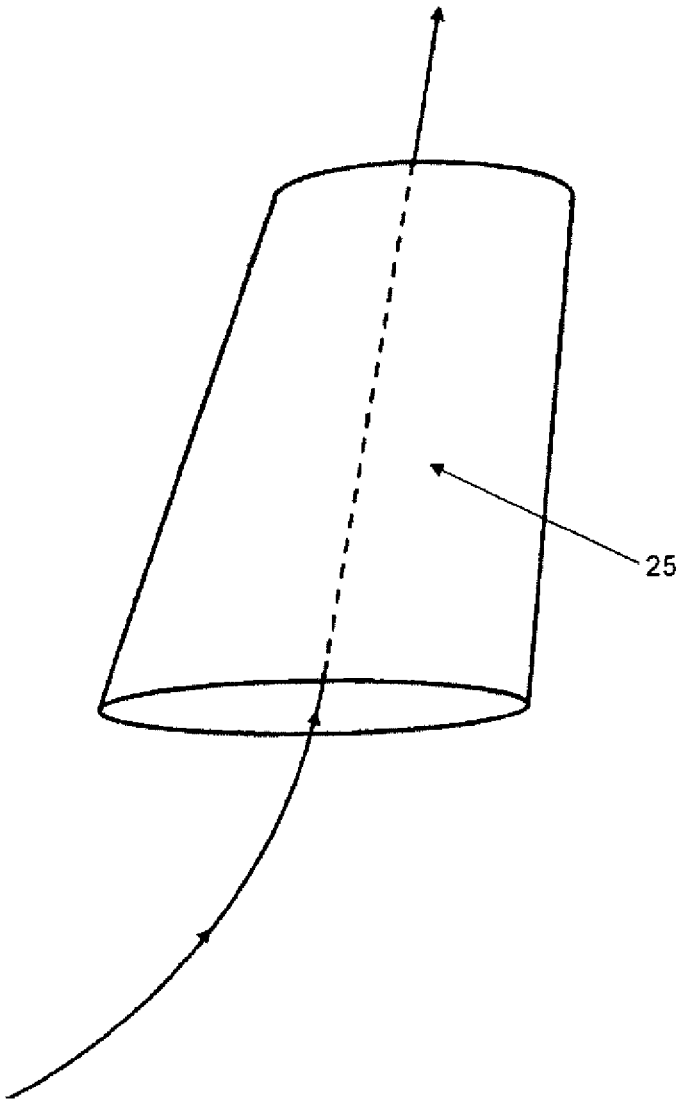
FIG. 7 illustrates a view of an outlet tube according to an embodiment of the present invention.

In FIG. 7, a detailed view of an outlet tube 25 is shown, in which it may be seen that the outlet tube 25 is foil-like in shape.

Figure 8:
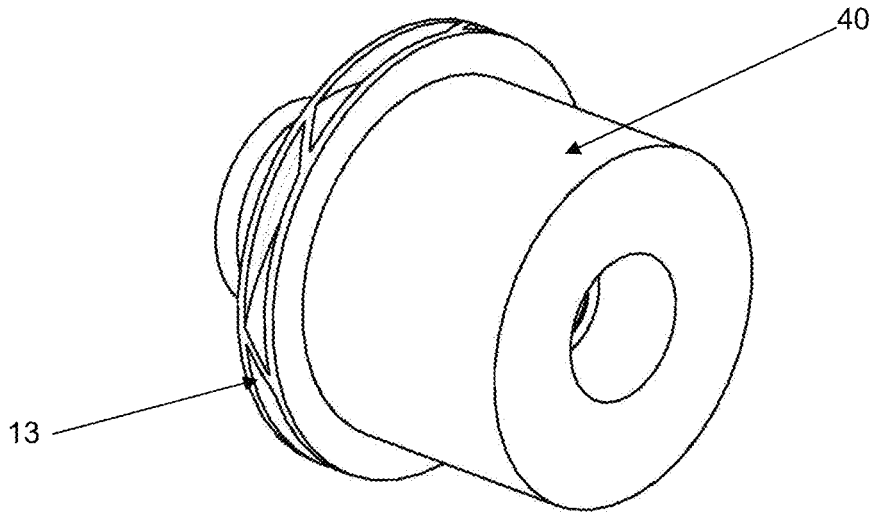
FIG. 8 illustrates a perspective view of anti-cavitation means according to an embodiment of the present invention.

In FIG. 8, a perspective view of anti-cavitation means 40 according to an embodiment of the present invention. The anti-cavitation means 40 comprises a cylindrical spigot attached at one end thereof to an impeller 13.

Figure 9:
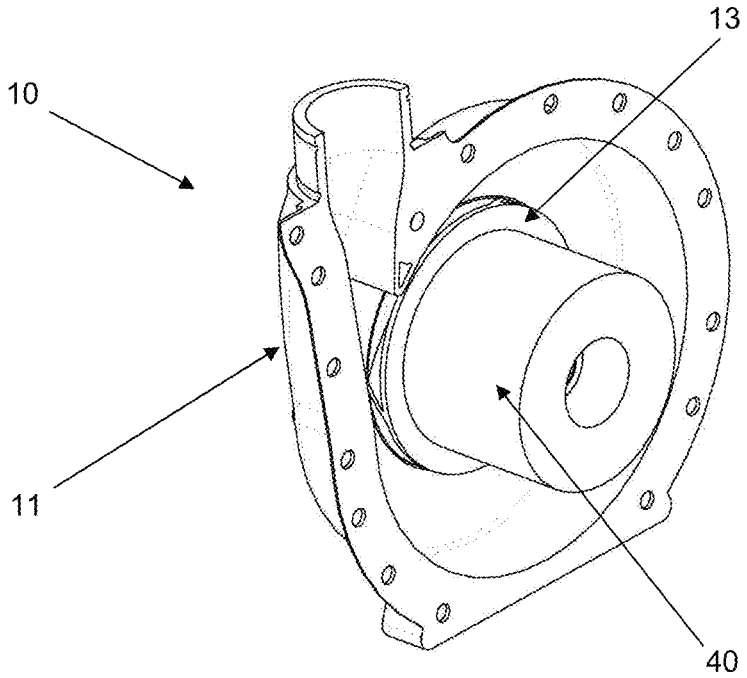
FIG. 9 illustrates a perspective view of anti-cavitation means according to an embodiment of the present invention.

In FIG. 9, the spigot 40 and impeller 13 of FIG. 8 are illustrated when assembled with the front wall 11 of the housing. In this Figure it may be seen that the spigot 40 extends between the front wall 11 and the rear wall (not shown) of the apparatus 10.

Figure 10:
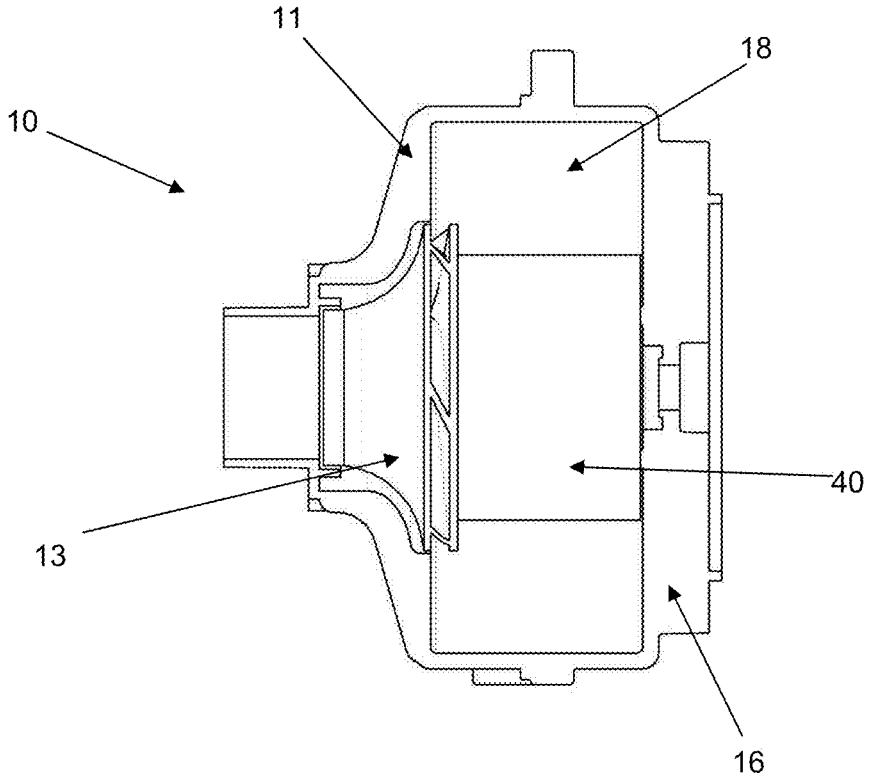
FIG. 10 illustrates a side cross-sectional view of an apparatus according to an embodiment of the present invention.

FIG. 10 illustrates a side cross-sectional view of an apparatus 10 according to an embodiment of the present invention. In this Figure, it may be clearly seen that the spigot 40 is attached to the impeller 13 such that rotation of the impeller 13 causes a corresponding rotation of the spigot 40 within the fluid rotation chamber 18.

It may further be seen that the spigot 40 extends substantially the entire distance between the front wall 11 and the rear wall 16 of the fluid rotation chamber 18.

Figure 11:
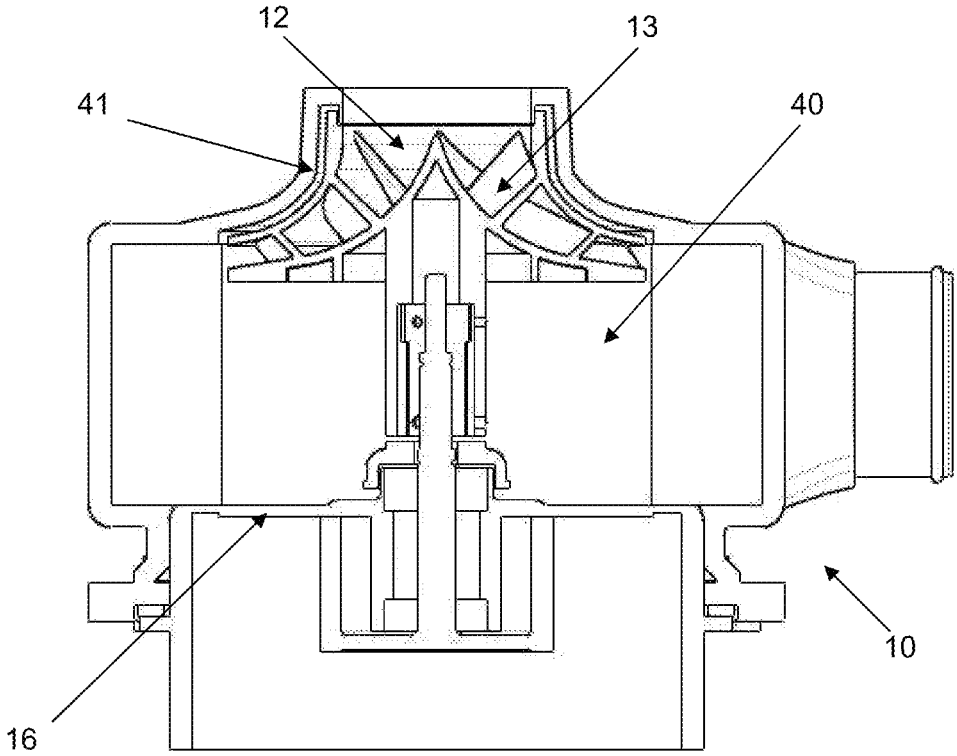
FIGS. 11-13 illustrate embodiments of the present invention in which the impeller is located at different positions within the apparatus.
Figure 12:
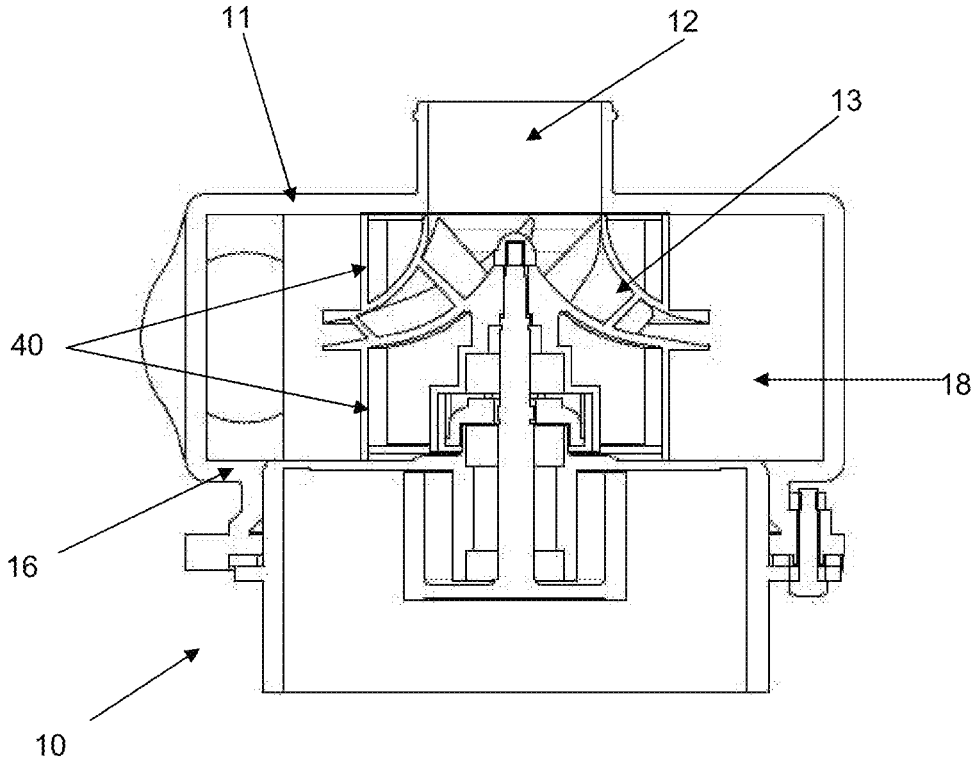
Figure 13:
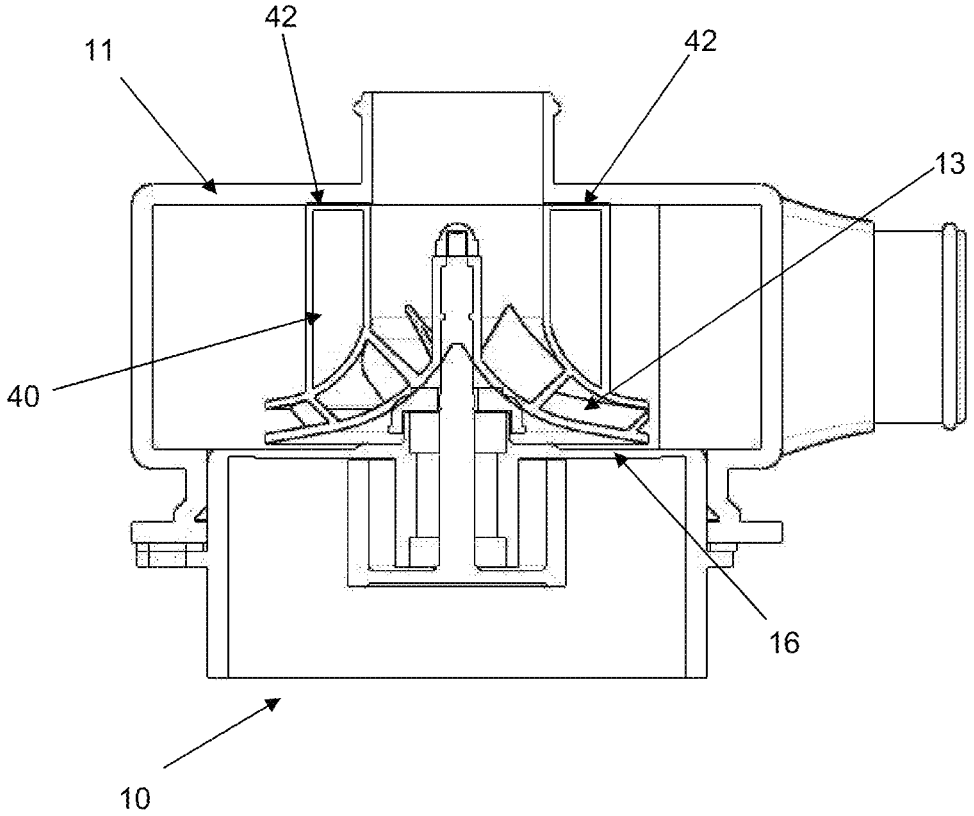

In FIGS. 11 to 13, embodiments of the present invention in which the impeller 13 is located at different positions within the apparatus 10 are illustrated. In FIG. 11, the impeller 13 is located at a position within the apparatus 10 such that the impeller 13 is positioned partially within the inlet 12. This is a similar arrangement to that illustrated in FIG. 4.

In this embodiment, a labyrinth seal 41 is located within the inlet 12 of the apparatus 10.

The anti-cavitation means 40 of FIG. 11 extends from the impeller 13 to adjacent the rear wall 16 of the apparatus 10.

In FIG. 12, the impeller 13 is located entirely within the fluid rotation chamber 18 adjacent the inlet 12. In this embodiment, no labyrinth seal is required.

It may be seen in this Figure that the anti-cavitation means 40 is associated with the impeller 13 and extends both from the impeller 13 in the direction of the front wall 11, and from the impeller in the direction of the rear wall 16.

Similarly, in FIG. 13, the impeller 13 is located adjacent the rear wall 16 of the apparatus. In this embodiment, the anti-cavitation means 40 extends from the impeller to adjacent the front wall 11. The inner surface of the front wall 11 is provided with a recess 42 in which a portion of the anti-cavitation means 40 is located, thereby reducing or eliminating the requirement to provide a labyrinth seal.

Figure 14:
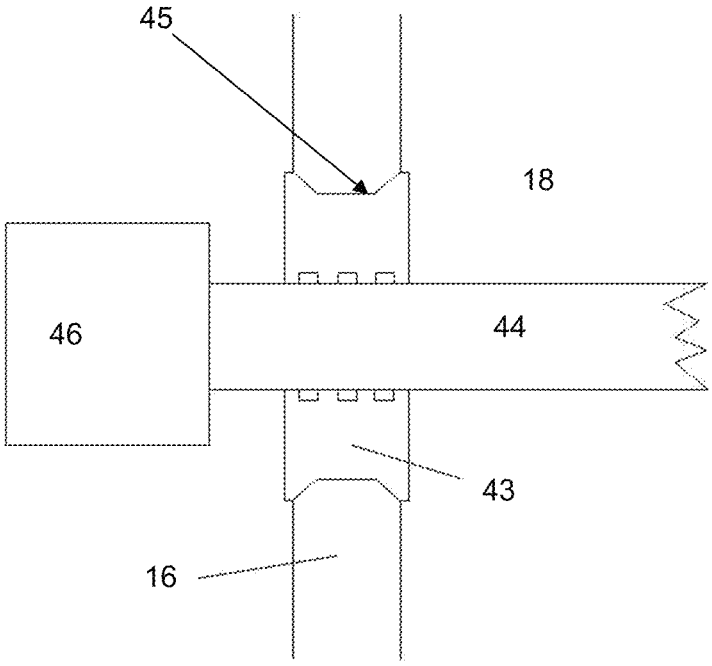
FIGS. 14-16 illustrate motor shaft seals according to embodiments of the present invention.
Figure 15:
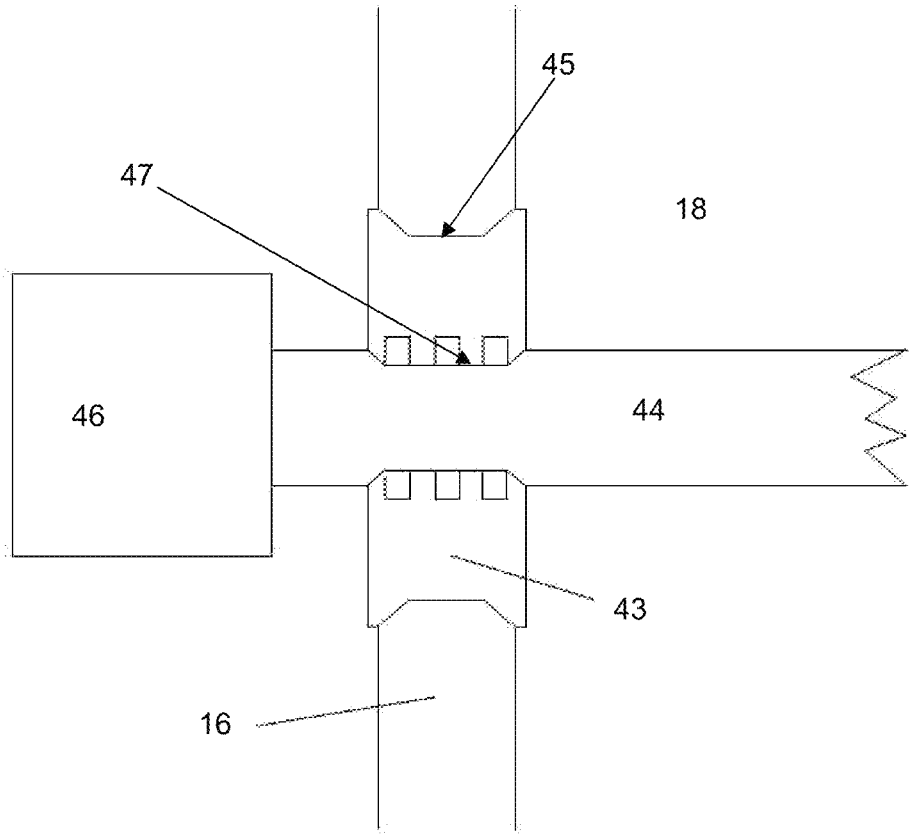
Figure 16:
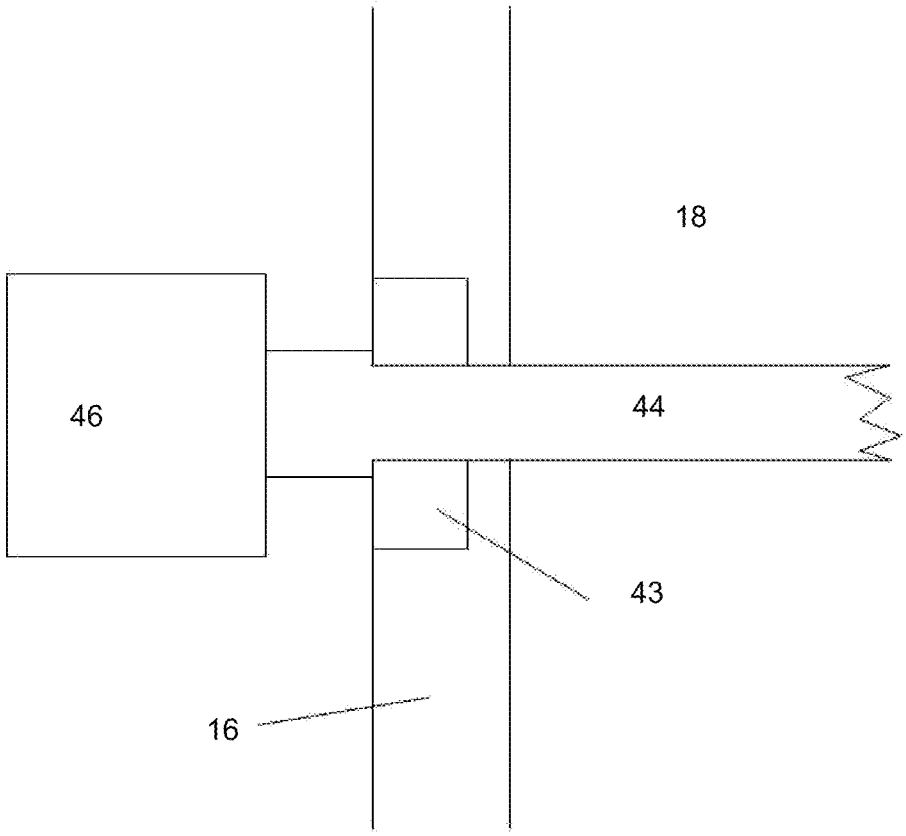

In FIGS. 14 to 16 there are illustrated motor shaft seals 42 according to embodiments of the present invention.

In FIGS. 14 and 15, the motor shaft seals 43 comprise annular rubber seals through which the motor shaft 44 passes. In FIG. 14, the seal 43 is provided with angles outer surfaces 45, such that, as the motor 46 causes rotation or the motor shaft 44, the seal 43 presses against the shaft 44, thereby preventing fluid from the fluid rotation chamber 18 passing through the rear wall 16 along the shaft 44 and into the motor 46.

A similar arrangement is illustrated in FIG. 15, although in this Figure, angled surfaces 45, 46 are provided on both the inner and outer surfaces of the seal. The angled surfaces 46 on the inner surface of the seal 43 are provided such that the inner surface of the seal 43 is in contact with the motor shaft 44 along the entire length of the seal 43.

Turning finally to FIG. 16, a similar arrangement to that shown in FIG. 14 is illustrated, with the exception that the seal 43 comprises a sealed bearing.

Those skilled in the art will appreciate that the present invention may be susceptible to variations and modifications other than those specifically described. It will be understood that the present invention encompasses all such variations and modifications that fall within its spirit and scope.

The invention claimed is:

1. An apparatus for pumping or compressing a fluid, the apparatus comprising:

a substantially cylindrical housing having a front wall, a rear wall and a side wall interconnecting the front and rear walls to define a fluid rotation chamber with a substantially cylindrical geometry and a substantially square or rectangular cross-sectional shape that is suitable for promoting solid body rotation of a fluid within the rotation chamber;

an inlet located in the front wall;

an impeller located so that fluid entering the apparatus through the inlet has rotation imparted to it by the impeller prior to entering the fluid rotation chamber;

a substantially cylindrical element extending between the front and rear walls and adapted to prevent fluid cavitation arising from the solid body rotation of the fluid; and at least one outlet in fluid communication with the housing, wherein the fluid rotation chamber and the rotation of fluid imparted by the impeller promote solid body rotation of the fluid in the fluid rotation chamber prior to the fluid exiting the apparatus through the at least one outlet.

2. An apparatus for pumping or compressing a fluid, the apparatus comprising:

a substantially cylindrical housing having a front wall, a rear wall and a side wall interconnecting the front and rear walls to define a fluid rotation chamber with a substantially cylindrical geometry and with a substantially square or rectangular cross-sectional shape that is suitable for promoting solid body rotation of a fluid within the rotation chamber;

an inlet located in the front wall;

rotation means adapted to impart rotation to fluid entering the apparatus so that fluid entering the apparatus through the inlet has rotation imparted to it by the rotation means prior to entering the fluid rotation chamber;

a substantially cylindrical element extending between the front and rear walls and adapted to prevent fluid cavitation arising from the solid body rotation of the fluid; and at least one outlet in fluid communication with the housing, wherein the fluid rotation chamber and the rotation of fluid imparted b the rotation means promote solid body rotation of the fluid in the fluid rotation chamber prior to the fluid exiting the apparatus through the at least one outlet.

3. An apparatus as claimed in claim 1, in which the front and rear walls join the side wall with a curve with a radius of less than 10 mm.

4. An apparatus as claimed in claim 1, in which an inlet is located centrally in the front wall, the impeller being located within the inlet.

5. An apparatus as claimed in claim 1, which further comprises an outlet pipe located tangentially to the front wall.

6. An apparatus as claimed in claim 1, in which the impeller is located at least partially within the inlet.

7. An apparatus as claimed in claim 1, in which the impeller is located in the inlet in such a manner that a portion of the impeller extends outwardly beyond at least a portion of the front wall of the housing.

8. An apparatus as claimed in claim 1, in which the impeller has a discharge portion from which fluid is discharged into the fluid rotation chamber and the discharge portion is located entirely within the fluid rotation chamber and is adapted to discharge fluid into the fluid rotation chamber in a direction substantially parallel to the front wall.

9. An apparatus as claimed in claim 1, in which the substantially cylindrical element is associated with the impeller such that rotation of the impeller causes a corresponding rotation of the cylindrical element within the fluid rotation chamber.

10. An apparatus as claimed in claim 9 in which the substantially cylindrical element is fabricated so that rotation of the cylindrical element results in entrainment of fluid.

11. An apparatus as claimed in claim 9, in which the substantially cylindrical element extends substantially an entire distance between the front wall and the rear wall of the fluid rotation chamber.

12. An apparatus as claimed in claim 1, in which the impeller is located entirely within the fluid rotation chamber adjacent the inlet.

13. An apparatus as claimed in claim 12, in which the cylindrical element extends both from the impeller in the direction of the front wall, and from the impeller in the direction of the rear wall.

14. An apparatus as claimed in claim 12, in which the impeller is located adjacent the rear wall.

15. An apparatus as claimed in claim 12, in which the cylindrical element extends from the impeller to adjacent the front wall.

* * * * *